US007106200B2

(12) United States Patent
Hall et al.

(10) Patent No.: US 7,106,200 B2
(45) Date of Patent: Sep. 12, 2006

(54) DEACTIVATOR USING RESONANT RECHARGE

(75) Inventors: Stewart E. Hall, Wellington, FL (US); Douglas A. Drew, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 108 days.

(21) Appl. No.: 10/865,020

(22) Filed: Jun. 10, 2004

(65) Prior Publication Data

US 2005/0275507 A1 Dec. 15, 2005

(51) Int. Cl.
*G08B 13/14* (2006.01)

(52) U.S. Cl. ..... 340/572.3; 340/572.5; 340/572.7; 340/572.1

(58) Field of Classification Search ..... 340/572.3, 340/572.5, 572.7
See application file for complete search history.

(56) References Cited

U.S. PATENT DOCUMENTS 5,781,111 A * 7/1998 Easter et al. ..... 340/572.3
6,111,507 A * 8/2000 Alicot et al. ..... 340/572.1
6,181,249 B1 * 1/2001 Maitin et al. ..... 340/572.3

* cited by examiner

*Primary Examiner*—Donnie L. Crosland
(74) *Attorney, Agent, or Firm*—Kacvinsky LLC

(57) ABSTRACT

A method and apparatus to perform resonant recharge transfers energy from an AC power source (e.g., a power line) or from a DC power source or from bulk capacitors to a deactivation capacitor. The resonant recharge occurs faster than conventional techniques without the need for dissipative current limiting control elements. Through the employment of a resonant approach, the natural impedance of the resonant circuit limits the current without high resistive losses of a limiting resistor or other current limiting regulator. This may increase the efficiency of the recharge circuit and may charge the deactivation capacitor to a voltage that is higher than the voltage of the power source.

54 Claims, 8 Drawing Sheets

DEACTIVATOR USING RESONANT RECHARGE

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

When a customer presents an article for payment at a checkout counter, a checkout clerk either removes the security tag from the article, or deactivates the security tag using a deactivation device. In the latter case, improvements in the deactivation device may facilitate the deactivation operation, thereby increasing convenience to both the customer and clerk. Consequently, there may be need for improvements in deactivating techniques in an EAS system.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DESCRIPTION OF SPECIFIC EMBODIMENTS

Figure 1:
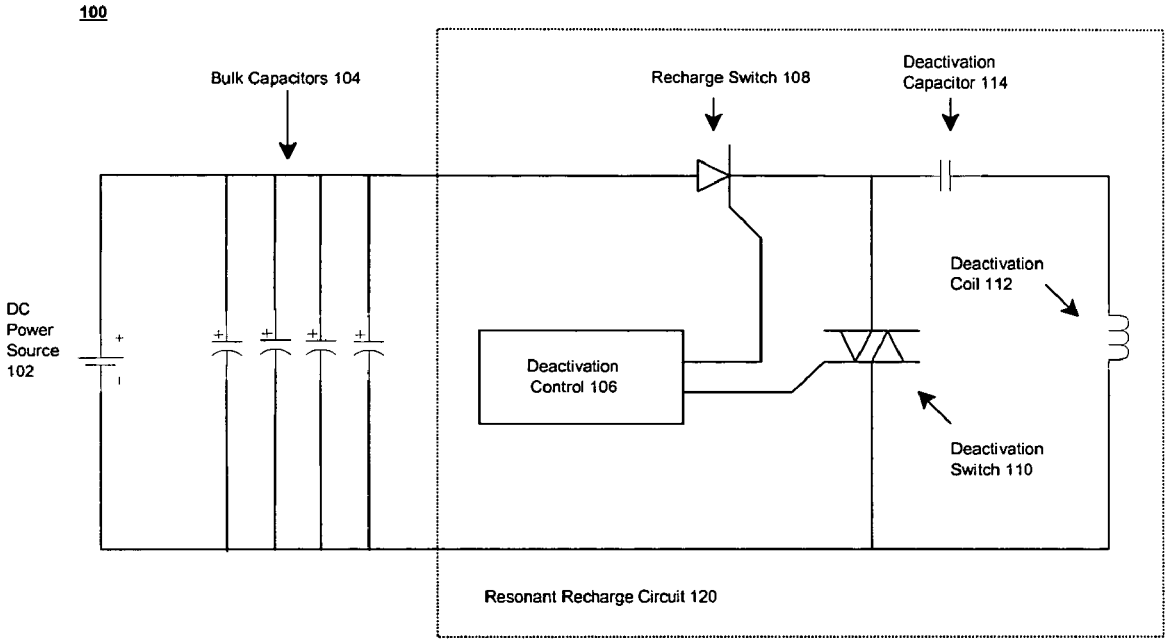
FIG. 1 illustrates a deactivator having a direct current (DC) power source in accordance with one embodiment.

Numerous specific details may be set forth herein to provide a thorough understanding of the embodiments. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

The embodiments may be directed to a deactivator for an EAS system. The deactivator may be used to deactivate an EAS security tag. The security tag may comprise, for example, an EAS marker encased within a hard or soft outer shell. The deactivator may create a deactivation field. The marker may be passed through the deactivation field to deactivate the marker. Once deactivated, the EAS security tag may pass through the interrogation zone without triggering an alarm.

An example of a marker for a security tag may be a magneto-mechanical marker. A magneto-mechanical marker may have two components. The first component may be a resonator made of one or more strips of a high permeability magnetic material that exhibits magneto-mechanical resonant phenomena. The second component may be a bias element made of one or more strips of a hard magnetic material. The state of the bias element sets the operating frequency of the marker. An active marker has its bias element magnetized setting its operating frequency within the range of EAS detection systems. Deactivation of the marker is accomplished by demagnetizing the bias element thereby shifting the operating frequency of the marker outside of the range of EAS detection systems. Techniques to demagnetize the bias element usually involve the application of an AC magnetic field that is gradually decreased in intensity to a point close to zero. To effectively demagnetize the bias element it may be necessary to apply a magnetic field strong enough to overcome the coercive force of the bias material prior to decreasing the intensity.

One technique to create this gradually decreasing AC magnetic field uses an inductor-capacitor (LC) resonant tank circuit. A deactivation capacitor may be charged prior to the beginning of the deactivation cycle. When the deactivation cycle begins, a switch connects the charged capacitor to a deactivation coil. Since this coil is inductive, it forms a resonant tank circuit with the charged deactivation capacitor. The resistances in the coil winding, the effective series resistance (ESR) of the switch and the deactivation capacitor, and the other losses in the circuit result in a resistive component in the LC resonant tank circuit. If the resistances in the tank circuit are low enough, the resulting LCR circuit will be under-damped and a gradually decreasing AC current will flow through the deactivator coil. This current flows through the winding of the deactivator coil creating a gradually decreasing AC magnetic field in the deactivation zone. The deactivation cycle is completed when the current in the coil and the deactivation magnetic field has decayed to a relatively low level. After the deactivation cycle is complete the deactivation capacitor is recharged. Once the deactivation capacitor is completely recharged, the deactivator is ready for another deactivation cycle.

While the deactivation capacitor is recharging, the deactivator cannot be used to deactivate any markers. It may therefore be desirable to reduce this recharge time, particular for high volume applications where a customer may desire to deactivate many products within a short period of time. This requirement may influence the design of the power supply used for the deactivator. For example, a typical fully charged deactivation capacitor may have a capacitance of approximately 100 Microfarads (uF) and be charged to approximately 500 volts (V). The amount of energy stored in the capacitor may be approximately 12.5 Joules. In high volume applications, it may be necessary to recharge the capacitor in less than 250 milliseconds. The power supply for this application would need to deliver an average of 50 Watts of power during the 250 milliseconds charge time to meet this requirement. The peak power requirements for the power supply are often substantially higher due to inrush current limiting that is needed when the capacitor is near 0 Volts. For this application, the power supply may be required to deliver a peak power of 100 Watts. Although the peak power requirements are relatively high, the average power requirement may be substantially lower. For example, the deactivator may be required to perform only one deactivation cycle per second on average. In a deactivator with a deactivation energy requirement of 12.5 joules, this is 12.5 Watts or $\frac{1}{8}^{th}$ of the peak power requirement.

Conventional techniques to recharge the deactivation capacitor may be unsatisfactory for a number of reasons. For example, the deactivation capacitor may be charged directly from a DC power supply capable of delivering high peak power to the capacitor to meet recharge time requirements. This approach, however, may increase the size and cost of the power supply. In another example, bulk capacitors may be used. The bulk capacitors may be kept charged to a voltage that is greater than the deactivation capacitor voltage. During the recharge time, a switch is turned on and current flows into the deactivation capacitor through a current limiting resistor. The resistance of the current limiting resistor is chosen to limit the peak currents during the capacitor recharge. If a switch is not used between the bulk capacitor and the resonant capacitor, the limiting resistor also must be sized to limit the current through the power supply output rectifier during the portion of the deactivation cycle when the deactivation capacitor is negatively biased with respect to the bulk capacitor.

Although the use of bulk capacitors with a current limiting resistor may help to reduce the peak power requirements of the power supply, there remain several disadvantages. For example, the use of bulk capacitors slows the rate at which the deactivation capacitor may be recharged. The rate is especially slow at the end of the recharge cycle when the deactivation capacitor voltage approaches the voltage on the bulk capacitors. The recharge rate may be improved by increasing the voltage of the bulk capacitors to a voltage substantially higher than the deactivation capacitor voltage or by increasing the current rating on the switch and power supply rectifiers and current limiting resistor, but this may increase the cost of the components. In another example, conventional techniques using bulk capacitors may be inefficient. The current limiting resistor consumes a substantial amount of power during the recharge. This decreases the efficiency of the deactivator and increases the average power of the power supply. In yet another example, the current limiting resistor usually requires heat sinking which also increases the cost of the deactivator.

The embodiments may solve these and other problems by using a resonant recharge approach to transfer energy from an AC power source such as the power line or from a DC power source or bulk capacitors to the deactivation capacitor. The resonant recharge occurs faster than conventional techniques without the need for dissipative current limiting control elements such as resistors or transistors. Because the embodiments use a resonant approach, the natural impedance of the resonant circuit limits the current without the high resistive losses of the limiting resistor or other current limiting regulator. This may increase the efficiency of the recharge circuit. Another potential advantage provided by the embodiments is that the deactivation capacitor may be charged to a voltage that is higher than the voltage of the AC or DC power source.

Referring now in detail to the drawings wherein like parts may be designated by like reference numerals throughout, there is illustrated in FIG. 1 a deactivator having a direct current (DC) power source in accordance with one embodiment. FIG. 1 illustrates a deactivator 100. Deactivator 100 may comprise a number of different elements. It may be appreciated that other elements may be added to deactivator 100, or substituted for the representative elements shown in FIG. 1, and still fall within the scope of the embodiments. The embodiments are not limited in this context.

In one embodiment, deactivator 100 may have a deactivation cycle and recharge cycle. During the deactivation cycle, deactivator 100 may be used to deactivate an EAS marker. During the recharge cycle, deactivator 100 may be recharged prior to the next deactivation cycle.

In one embodiment, a DC power source 102 and a set of bulk capacitors 104 may be used as a power source for deactivator 100. In this case, a resonant recharge circuit 120 may be connected between bulk capacitors 104 and a deactivation capacitor 114. If the capacitance of bulk capacitors 104 is much greater than that of deactivation capacitor 114, the resonant frequency of resonant recharge circuit 120 may approximately match the deactivation resonant frequency. Also the relatively large bulk capacitance allows the rating on the power supply to be reduced to supply only the average deactivation power rather than the peak power.

In one embodiment, resonant recharge circuit 120 may have a recharge switch 108 coupled between DC power source 102 and bulk capacitors 104, and deactivation capacitor 114 through a deactivation coil 112. Resonant recharge circuit 120 may further comprise a deactivation control 106 coupled to recharge switch 108 and a deactivation switch 110.

During the deactivation cycle, deactivation control 106 may turn recharge switch 108 to an off state and deactivation switch 110 to an on state. This may cause deactivation capacitor 114 to discharge into deactivation coil 112. If the combined resistance of deactivation coil 112, the equivalent series resistance (ESR) of deactivation capacitor 114, and the ESR of deactivation switch 110, is set low enough, resonant recharge circuit 120 will form an under-damped resonance and create the desired slowly decreasing AC current through deactivation coil 112 to form the proper deactivation field in the deactivation zone around the deactivation coil.

During the recharge cycle, deactivation control 106 may turn recharge switch 108 to an on state and deactivation switch 110 to an off state. This may allow a resonant charge pulse from deactivation coil 112 to charge deactivation capacitor 114 in preparation for the next deactivation cycle. Although the recharge may occur at any time prior to the deactivation cycle, it may be advantageous to configure deactivation control 106 to recharge deactivation capacitor 114 immediately prior to the deactivation cycle, as discussed in more detail below.

In one embodiment, recharge switch 108 and deactivation switch 110 may be implemented with many different types of semiconductors. In one embodiment, for example, recharge switch 108 may be implemented using a Silicon Controlled Rectifier (SCR), parallel inverted SCR, bipolar transistor, insulated gate bipolar transistor (IGBT), metal oxide semiconductor field effect transistor (MOSFET) with a series diode, relay, and so forth. In one embodiment, for example, deactivation switch 110 may be implemented using a Triac, parallel inverted SCR, IGBT, MOSFET, relay, and so forth. The embodiments are not limited in this context.

Figure 2:
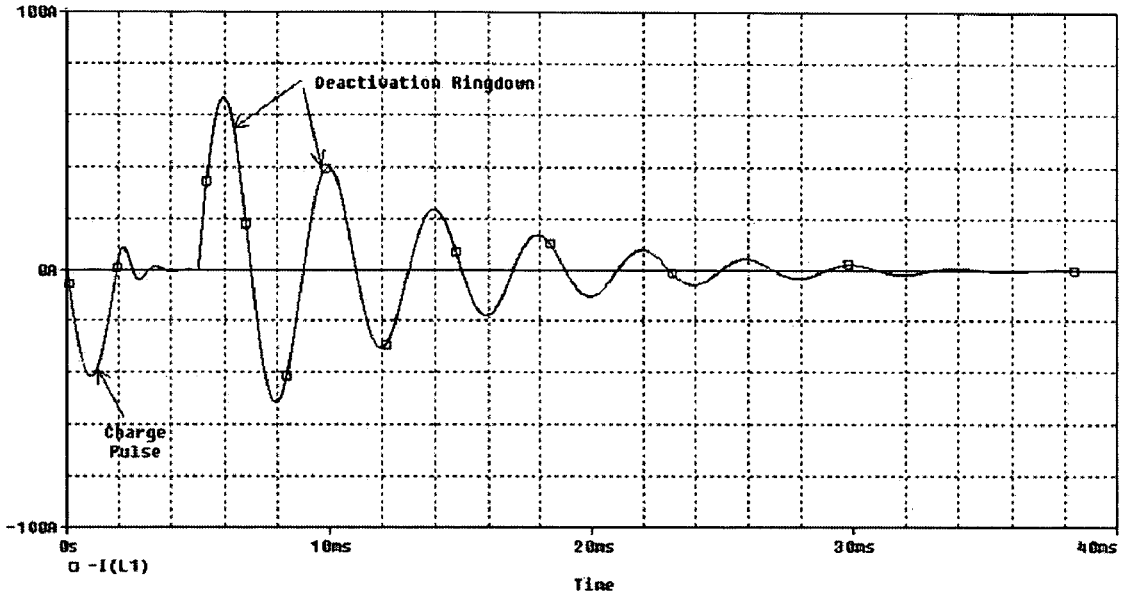
FIG. 2 illustrates a graph of a current waveform in a deactivation coil having a DC power source in accordance with one embodiment.

FIG. 2 illustrates a graph of a current waveform in a deactivation coil having a DC power source in accordance with one embodiment. FIG. 2 shows the current through deactivation coil 112. The negative current pulse shown at the beginning of the waveform is the resonant charge pulse flowing through deactivation coil 112 into deactivation capacitor 114. The initial pulse may be sufficient to fully charge deactivation capacitor 114. The resonant impedance of the LC circuit limits the current in recharge switch 108. The peak current in this example is limited to approximately 40 Amps. This example shows that deactivation capacitor 114 may be fully charged in approximately 2 milliseconds.

Figure 3:
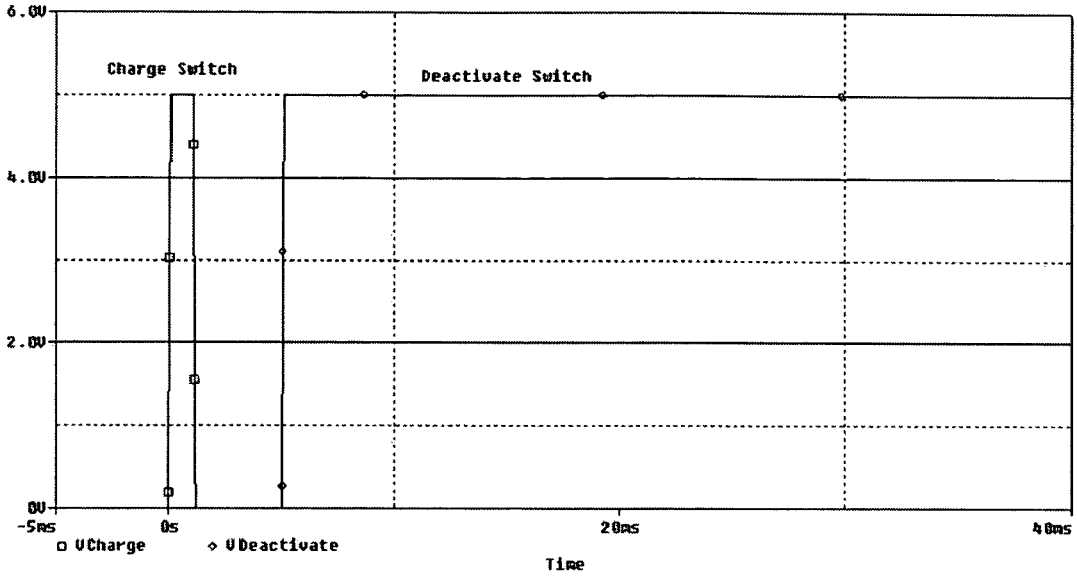
FIG. 3 illustrates a graph of a timing waveform in a deactivation coil having a DC power source in accordance with one embodiment.

FIG. 3 illustrates a graph of a timing waveform in a deactivation coil having a DC power source in accordance with one embodiment. FIG. 3 shows an example of some timing waveforms coming from deactivation control circuit 106. In this case, the first pulse turns on recharge switch 108. The second pulse turns on deactivation switch 110 to allow the energy in deactivation capacitor 114 to ring-down through deactivation coil 112.

Figure 4:
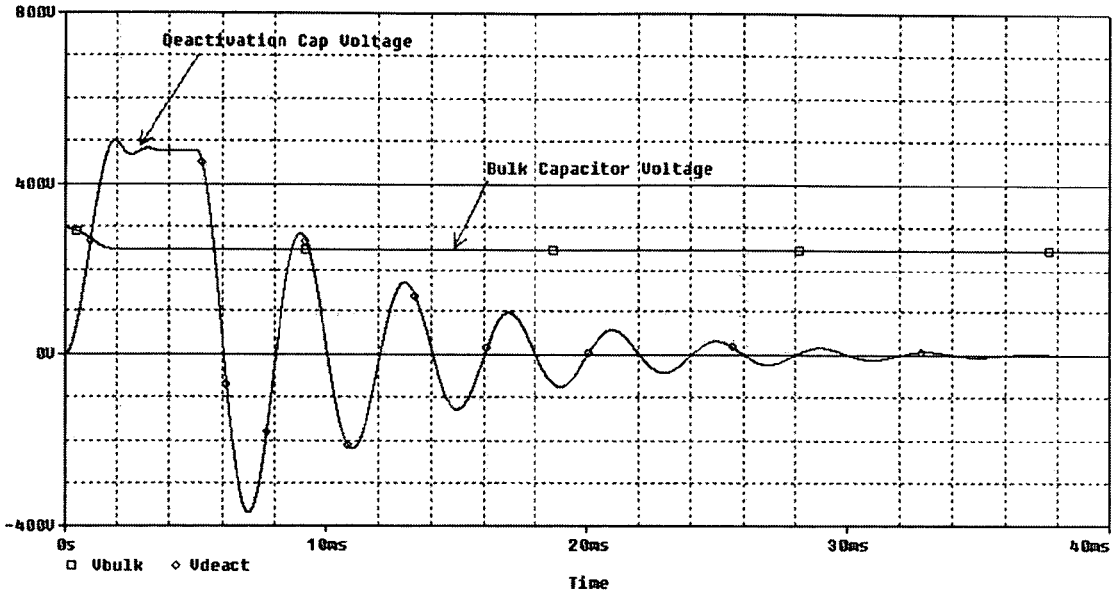
FIG. 4 illustrates a graph of voltage waveforms in a deactivation capacitor and a set of bulk capacitors having a DC power source in accordance with one embodiment.

FIG. 4 illustrates a graph of current waveforms in a deactivation capacitor and a set of bulk capacitors having a DC power source in accordance with one embodiment. FIG. 4 shows a deactivation capacitor voltage waveform on deactivator capacitor 114. When deactivation control circuit 106 turns on recharge switch 108, deactivation capacitor 114 is charged relatively quickly through deactivation coil 112. The recharge may take only ½ of a cycle at the resonant frequency. Deactivation capacitor 114 in this example is charged to approximately 475 V in approximately 2 milliseconds.

FIG. 4 also shows a bulk capacitor voltage waveform on bulk capacitors 104. During the resonant recharge time, a relatively high current flows from bulk capacitors 104 limited by the resonant impedance of the LC tank circuit. During this time bulk capacitors 104 drop from approximately 300V down to approximately 250V. A larger capacitance value for bulk capacitors 104 would allow a lower voltage drop. Also, a larger number of bulk capacitors 104 placed in parallel may allow for lower charge pulse currents in each of the individual capacitors. The embodiments are not limited in this context.

Figure 5:
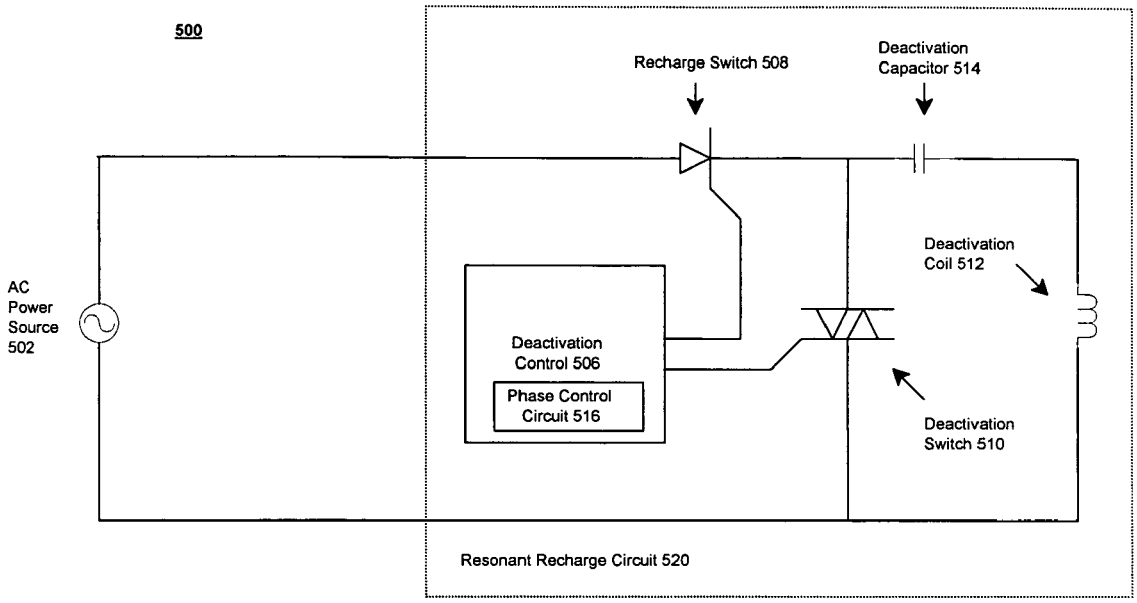
FIG. 5 illustrates a deactivator having an alternating current (AC) power source in accordance with one embodiment.

FIG. 5 illustrates a deactivator having an alternating current (AC) power source in accordance with one embodiment. FIG. 5 illustrates a deactivator 500. Deactivator 500 may comprise an AC current source 502 coupled to a resonant recharge circuit 520. AC power source 502 may comprise, for example, the power mains for a retail store or market. Resonant recharge circuit 520 shown in FIG. 5 may be similar to resonant recharge circuit 120 show in FIG. 1. Deactivation control circuit 506, however, may further comprise a phase control circuit 516 for use in timing operations for recharge switch 508 and deactivation switch 510.

In one embodiment, resonant recharge circuit 520 may be connected directly to AC power source 502. In this case, the resonant recharge approach may be appropriate if the resonant frequency of the LC tank circuit formed by deactivation capacitor 514 and deactivation coil 512 is higher than the frequency of AC power source 502. Although LC resonant frequencies may be used that are the same as, or even lower than, the frequency of AC power source 502, it may be advantageous to use a LC resonant frequency that is substantially higher than the frequency of AC power source 502. Using LC resonant frequencies that are higher than the frequency of AC power source 502 may allow a strong resonant pulse to form during the recharge cycle.

Figure 6:
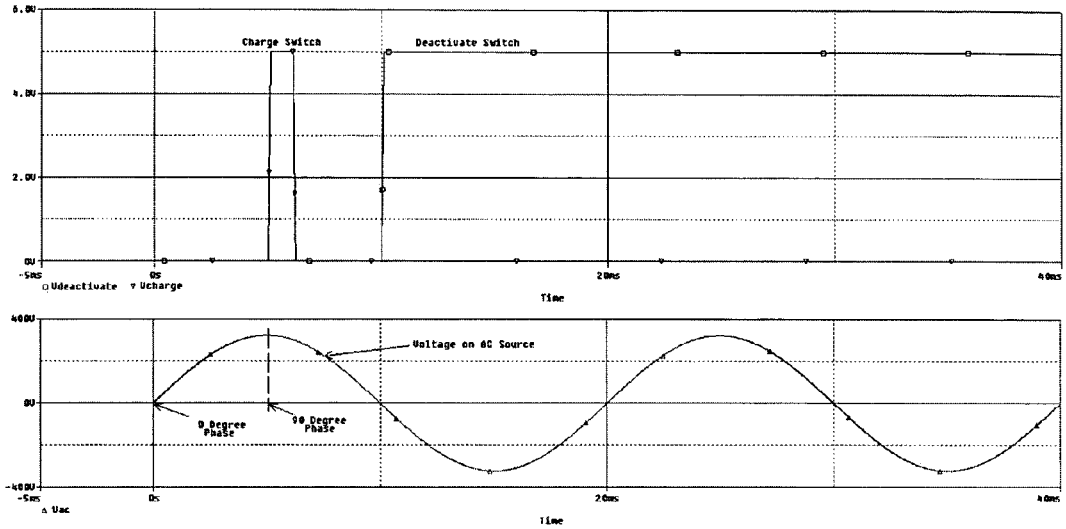
FIG. 6 illustrates a graph of timing waveforms for a recharge switch and deactivation switch having an AC power source in accordance with one embodiment.

FIG. 6 illustrates a graph of timing waveforms for a recharge switch and deactivation switch having an AC power source in accordance with one embodiment. As discussed previously, deactivation control circuit 506 may use phase control circuit 516 in timing operations for recharge switch 508 and deactivation switch 510 during the deactivation and recharge cycles. In one embodiment, for example, the charge voltage of deactivation capacitor 514 may be controlled by adjusting the timing of the start of the resonant recharge cycle. This approach may be used to regulate the charge voltage of deactivation capacitor 514 with changes in the voltage of AC power source 502, or to allow adjustments of the strength of the deactivation field for different applications.

In one embodiment, deactivation control circuit 506 may control the voltage on deactivation capacitor 514 by adjusting the timing for when recharge switch 508 is turned on. FIG. 6 shows the timing waveforms for recharge switch 508 and deactivation switch 510. As shown in FIG. 6, the phase angle of the turn-on of recharge switch 508 is referenced to the positive zero crossing of AC power source 502. The point of the positive zero crossing of the voltage waveform is referenced to be 0 degrees. The turn on of recharge switch 508 may be timed at any time when the voltage waveform for AC power source 502 is positive.

In one embodiment, deactivation control 506 and phase control circuit 516 provides the capability to regulate the charge voltage on deactivation capacitor 514 by adjusting the phase angle of the turn-on of recharge switch 508. FIG. 6 shows the timing waveforms when recharge switch 508 is turned-on at a phase angle of 90 degrees. Deactivation switch 110 may be turned on after the current has dropped to zero in recharge switch 508 and recharge switch 508 has been turned off. Although deactivation switch 510 may be turned on at anytime after recharge switch 508 has been turned off, it may be advantageous to turn on deactivation switch 510 at a subsequent zero crossing of the voltage waveform for AC power source 502, as shown in FIG. 6.

Figure 7:
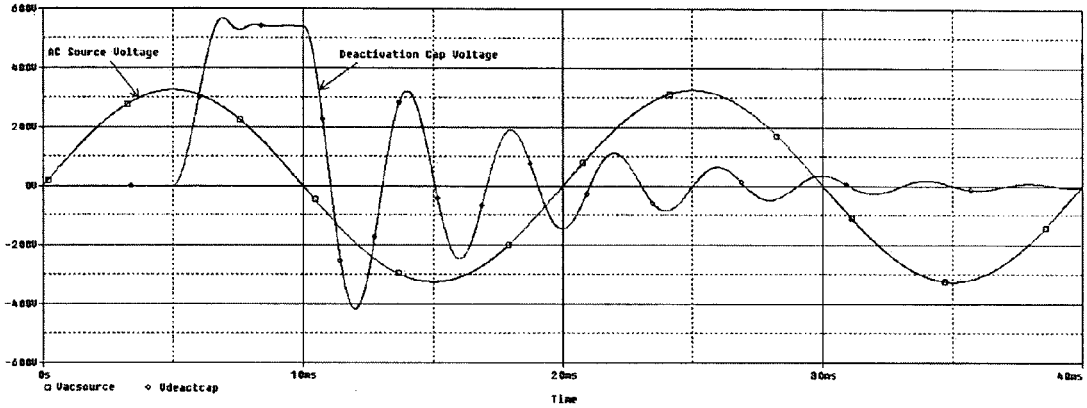
FIG. 7 illustrates a graph of voltage waveforms for an AC power source and a deactivation capacitor in accordance with one embodiment.

FIG. 7 illustrates a graph of voltage waveforms for an AC power source and a deactivation capacitor in accordance with one embodiment. FIG. 7 shows the voltage waveforms at AC power source 502 and on deactivation capacitor 514 when recharge switch 508 is turned on at a phase angle of 90 degrees. In this case, AC power source 502 is approximately 230 Vrms, 50 Hz source. At a phase angle of 90 degrees deactivation capacitor 514 may be fully charged to a voltage of approximately 530 Vdc.

Figure 8:
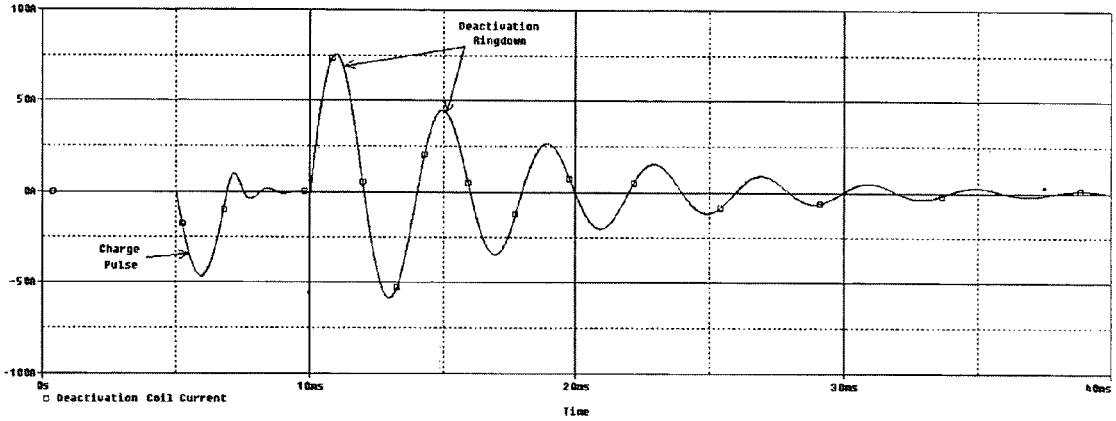
FIG. 8 illustrates a graph of a current waveform for a deactivation coil having an AC power source in accordance with one embodiment.

FIG. 8 illustrates a graph of a current waveform for a deactivation coil having an AC power source in accordance with one embodiment. FIG. 8 shows the resulting currents in deactivation coil 512. The initial charge pulse through deactivation coil 512 may begin at 5 milliseconds when recharge switch 508 is turned on. This pulse is the result of the resonance of the inductance of deactivation coil 512 and deactivation capacitor 514. After the resonant recharge pulse is complete, deactivation switch 510 may be turned on allowing the energy in deactivation capacitor 514 to ring-down through deactivation switch 510 in the resonant LC circuit formed by deactivation capacitor 514 and deactivation coil 510.

It may be appreciated that the resonant recharge techniques described herein may be implemented using different circuit configurations. For example, resonant recharge circuits 120 and/or 520 may be implemented with inductive elements besides the deactivator coil to provide inductance for the LC resonant charge circuit. In another example, deactivator 500 may also be implemented with a transformer or auto-transformer for isolation or increasing or decreasing the voltage from AC power source 502. In yet another example, resonant recharge circuits 120 and/or 520 may be modified to perform recharging of the deactivation capacitor during both positive and negative excursions of the AC source voltage. In yet another example, a control circuit or control logic may be implemented to allow partial charging of the deactivation capacitor during successive cycles of AC power source 502 to limit the currents flowing from AC power source 502. In still another example, alternate types of components may be utilized for both the deactivation switch and/or the recharge switch. The embodiments are not limited in this context.

The resonant recharge techniques described herein may provide several advantages for EAS deactivators. For example, the embodiments may use the inductive element of the deactivation coil and the deactivation capacitor for its resonant elements in the resonant recharge circuit. This allows the resonant recharge circuit to be implemented without the need for additional expensive inductive elements. In another example, the deactivation capacitor is fully recharged in ½ of a cycle of resonance. Because this can occur almost instantaneously, the deactivation capacitor may be recharged very rapidly at the beginning of the deactivation cycle. This may eliminate the need for a recharge period during which the deactivator may not be used. Since the deactivation capacitor is idled in a discharged state, this may also extend the life of the capacitor or allow use of less expensive deactivation capacitors. In yet another example, if the recharge circuit is connected to an AC power source such as AC power source 502, a phase control circuit such as phase control circuit 516 may be used to control the charge voltage on the deactivation capacitor. This provides a technique for line regulation. In still another example, there may be no need for additional circuitry to monitor the deactivation capacitor voltage or to periodically recharge the capacitor during idle periods to compensate for leakage currents in the deactivation capacitor. This may save both energy and cost. This feature may be especially valuable in battery-operated units where efficiency is important. In yet another example, the resonant recharge circuit may be used to recharge the deactivation capacitor to a voltage greater than the voltage at the source. This allows the use of voltages on the deactivation capacitor that are higher than the source voltage without adding a power supply to boost the voltage above that available at the input terminals. In still another example, there may be some applications where the deactivation throughput must be very high to quickly process a number of deactivations during a short period of time followed by an idle time. For such applications, the power supply and bulk capacitance may be sized to provide for higher throughput without increasing the average power rating of the power supply. With a larger bulk capacitor, for example, the deactivator may be designed to handle a peak throughput of 10–12.5 Joule deactivations at 1 deactivation per second (125 Joules, 12.5 Watts) followed by an idle period of 10 seconds (0 Joules, 0 Watts) with a power supply designed to deliver only 6.25 W to the bulk capacitors. In yet another example, for battery-operated deactivators, the lower peak power requirements may accommodate the use of batteries with higher ESR. For instance, this may enable the use of Nickel Metal Hydride batteries with higher energy density but higher ESR rather than Nickel Cadmium batteries with lower energy density but lower ESR. It may be appreciated that these are only some of the advantages provided by the resonant recharge techniques described herein. The embodiments are not limited in this context.

It may be appreciated that a deactivator arranged to use the resonant recharge techniques as described herein may be implemented in a number of different ways. The following description may comprise some examples of such implementations.

In one embodiment, for example, the deactivator may comprise a power source connected to a deactivation antenna coil and an energy storage capacitor, the deactivator to use an impedance formed by a resonant impedance of the deactivator antenna coil and a capacitance of the energy storage capacitor to limit an amplitude and duration of an input charge current pulse.

In one embodiment, the power source may comprise a DC power source. The DC power source comprises at least one of a DC power supply, a DC power supply with a bank of capacitors, a bank of at least one battery, a bank of at least one battery and a bank of capacitors, and a bank of at least one charged capacitor.

In one embodiment, the power source may comprise an AC power source. The AC power source may comprise at least one of a non-rectified AC source, a half wave rectified AC source, and a full wave rectified AC source.

In one embodiment, the deactivation antenna coil and the energy storage capacitor may be arranged to form an LC resonant tank circuit. The deactivation antenna coil may have an inductance of between approximately 100 μH to 100 mH, and the energy storage capacitor has a capacitance of between approximately 10 μF and 10 mF. The frequency for a resonance formed by the LC resonant tank circuit may range from a frequency that is approximately equal to a frequency for an AC source voltage of the AC power source to approximately one hundred times greater than a frequency for the AC source voltage.

In one embodiment, the LC resonant tank circuit may be connected to a charging circuit having an electronic control and charge switch. The charging circuit may be arranged to control a direction of power flow from the power source into and out of the LC resonant tank circuit. The charging circuit may include a uni-directional charging circuit or a bi-directional charging circuit.

In one embodiment, the charging circuit may control timing of current flow with respect to an AC source voltage for the AC power source. The charging circuit may charge the energy storage capacitor during a positive excursion of the AC source voltage, a negative excursion of the AC source voltage, or a combination of both a positive and negative excursion of the AC source voltage. The embodiments are not limited in this context.

In one embodiment, the charging circuit may charge the energy storage capacitor during a positive excursion of the AC source voltage. For example, the charging circuit may provide a full charge for the energy storage capacitor during a single positive excursion of the AC source voltage. In another example, the charging circuit may provide a partial charge for the energy storage capacitor during each of two or more successive positive excursions of the AC source voltage.

In one embodiment, the charging circuit may charge the energy storage capacitor during a negative excursion of the AC source voltage. For example, the charging circuit may provide a full charge for the energy storage capacitor during a single negative excursion of the AC source voltage. In another example, the charging circuit may provide a partial charge for the energy storage capacitor during each of two or more successive negative excursions of the AC source voltage.

In one embodiment, the charging circuit may charge the energy storage capacitor during both positive and negative excursions of the AC source voltage. For example, the charging circuit may provide a partial charge for the energy storage capacitor during each of a series of successive positive and negative excursions of the AC source voltage.

While certain features of the embodiments have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An apparatus, comprising:

a power source; and a deactivator to connect to said power source, said deactivator having a deactivation antenna coil and an energy storage capacitor, said deactivator to use an impedance formed by a resonant impedance of said deactivator antenna coil and a capacitance of said energy storage capacitor to limit an amplitude and duration of an input charge current pulse derived from said power source.

2. The apparatus of claim 1, wherein said power source is a direct current power source.

3. The apparatus of claim 2, wherein said direct current power source comprises at least one of a direct current power supply, a direct current power supply with at least one capacitor, a bank of at least one battery, a bank of at least one battery and at least one capacitor, and a bank of at least one charged capacitor.

4. The apparatus of claim 1, wherein said power source is an alternating current power source.

5. The apparatus of claim 4, wherein said alternating current power source comprises at least one of a non-rectified alternating current source, a half wave rectified alternating current source, and a full wave rectified alternating current source.

6. The apparatus of claim 4, wherein said deactivation antenna coil and said energy storage capacitor are arranged to form an inductor-capacitor resonant tank circuit.

7. The apparatus of claim 6, wherein said deactivation antenna coil has an inductance of between approximately 100 microhenry to 100 millihenry, and said energy storage capacitor has a capacitance of between approximately 10 microfarad and 10 millifarad.

8. The apparatus of claim 6, wherein a frequency for a resonance formed by said LC resonant tank circuit ranges from a frequency that is approximately equal to a frequency for an alternating current source voltage of said alternating current power source to approximately one hundred times greater than a frequency for said alternating current source voltage.

9. The apparatus of claim 6, further comprising a charging circuit having an electronic control and charge switch, said charging circuit to control a direction of power flow from said power source into and out of said inductor-capacitor resonant tank circuit.

10. The apparatus of claim 9, wherein said charging circuit comprises at least one of a uni-directional charging circuit and a bi-directional charging circuit.

11. The apparatus of claim 4, further comprising a charging circuit having an electronic control and charge switch, said charging circuit to control timing of current flow with respect to an alternating current source voltage for said alternating current power source.

12. The apparatus of claim 11, wherein said charging circuit charges said energy storage capacitor during a positive excursion of said alternating current source voltage.

13. The apparatus of claim 11, wherein said charging circuit provides a full charge for said energy storage capacitor during a single positive excursion of said alternating current source voltage.

14. The apparatus of claim 11, wherein said charging circuit provides a partial charge for said energy storage capacitor during each of two or more successive positive excursions of said alternating current source voltage.

15. The apparatus of claim 11, wherein said charging circuit charges said energy storage capacitor during a negative excursion of said alternating current source voltage.

16. The apparatus of claim 11, wherein said charging circuit provides a full charge for said energy storage capacitor during a single negative excursion of said alternating current source voltage.

17. The apparatus of claim 11, wherein said charging circuit provides a partial charge for said energy storage capacitor during each of two or more successive negative excursions of said alternating current source voltage.

18. The apparatus of claim 11, wherein said charging circuit charges said energy storage capacitor during both positive and negative excursions of said alternating current source voltage.

19. The apparatus of claim 11, wherein said charging circuit provides a partial charge for said energy storage capacitor during each of a series of successive positive and negative excursions of said alternating current source voltage.

20. A deactivator, comprising:

a current power source; and a resonant recharge circuit having a recharge switch coupled between said current power source and a deactivation capacitor through a deactivation coil, and a deactivation control coupled to said recharge switch and a deactivation switch, said deactivation control to turn said recharge switch on and said deactivation switch off to charge said deactivation capacitor with a resonant charge pulse, and said deactivation control to turn said recharge switch off and said deactivation switch on to send current from said deactivation capacitor to said deactivation coil to create a deactivation field.

21. The deactivator of claim 20, wherein said deactivation coil receives said current and generates said deactivation field in accordance with a current waveform, said current waveform having an initial current pulse to form said resonant charge pulse flowing through said deactivation coil into said deactivation capacitor to charge said deactivation capacitor.

22. The deactivator of claim 20, wherein said recharge switch comprises one of a silicon controlled rectifier, parallel inverted silicon controlled rectifier, bipolar transistor, insulated gate bipolar transistor, metal oxide semiconductor field effect transistor with a series diode, and relay.

23. The deactivator of claim 20, wherein said deactivation switch comprises one of a Triac, parallel inverted silicon controlled rectifier, insulated gate bipolar transistor, metal oxide semiconductor field effect transistor, and relay.

24. The deactivator cit claim 20, wherein said power source comprises a direct current power source and a set of bulk capacitors coupled to said recharge switch.

25. The deactivator of claim 24, wherein a capacitance for said bulk capacitors is greater than or equal to a capacitance for said deactivation capacitor.

26. The deactivator of claim 24, wherein said resonant recharge circuit generates a resonant frequency substantially equal to or greater than a resonant frequency for said deactivation field.

27. The deactivator of claim 24, wherein said deactivation control operates in accordance with a timing waveform, with a first pulse of said timing waveform to turn on said recharge switch, and a second pulse of said timing waveform to turn on said deactivation switch.

28. The deactivator of claim 24, wherein said deactivation control operates in accordance with a timing waveform, with a first pulse of said timing waveform to turn on said deactivation switch, and a second pulse of said timing waveform to turn on said recharge switch.

29. The deactivator of claim 20, wherein said power source comprises an alternating current power source coupled to said recharge switch.

30. The deactivator of claim 29, wherein said resonant recharge circuit generates a resonant frequency higher than a frequency for said alternating current power source.

31. The deactivator of claim 29, wherein said deactivation control controls a voltage on said deactivation capacitor by adjusting when said recharge switch is turned on.

32. The deactivator of claim 31, wherein said deactivation control turns on said recharge switch in accordance with a phase angle for a voltage waveform for said alternating current power source.

33. The deactivator of claim 32, wherein a positive zero crossing of said voltage waveform is referenced to be zero degrees, and said deactivation control turns on said recharge switch when said voltage for said alternating current power source is positive.

34. The deactivator of claim 32, wherein a positive zero crossing of said voltage waveform is referenced to be zero degrees, and said deactivation control turns on said recharge switch when said voltage for said alternating current power source is positive and has a phase angle of approximately 90 degrees.

35. The deactivator of claim 32, wherein said deactivation control adjusts phase angle during a positive alternating current voltage to allow control of deactivation capacitor voltage or charge current.

36. The deactivator of claim 32, wherein said deactivation control adjusts phase angle during a positive alternating current voltage to compensate for changes in said alternating current source voltage.

37. The deactivator of claim 32, wherein a negative zero crossing of said voltage waveform is referenced to be zero degrees, and said deactivation control turns on said recharge switch when said voltage for said alternating currant power source is negative.

38. The deactivator of claim 32, wherein a negative zero crossing of said voltage waveform is referenced to be zero degrees, and said deactivation control turns on said recharge switch when said voltage for said alternating current power source is negative and has a phase angle of approximately 90 degrees.

39. The deactivator of claim 32, wherein said deactivation control adjusts phase angle during a negative alternating current voltage to allow control of deactivation capacitor voltage or charge current.

40. The deactivator of claim 32, wherein said deactivation control adjusts phase angle during a negative alternating current voltage to compensate for changes in said alternating current source voltage.

41. The deactivator of claim 32, wherein said deactivation control turns on said deactivation switch once a current has dropped to zero in said recharge switch and said recharge switch has been turned off.

42. The deactivator of claim 41, wherein said deactivation controls turns on said deactivation switch at a subsequent zero crossing of said voltage waveform for said alternating current power source.

43. The deactivator of claim 29, wherein said resonant recharge circuit charges said deactivation capacitor during a positive excursion of said alternating current source voltage.

44. The deactivator of claim 29, wherein said resonant recharge circuit provides a full charge for said deactivation capacitor during a single positive excursion of said alternating current source voltage.

45. The deactivator of claim 29, wherein said resonant recharge circuit provides a partial charge for said deactivation capacitor during each of two or more successive positive excursions of said alternating current source voltage.

46. The deactivator of claim 29, wherein said resonant recharge circuit charges said deactivation capacitor during a negative excursion of said alternating current source voltage.

47. The deactivator of claim 29, wherein said resonant recharge circuit provides a full charge for said deactivation capacitor during a single negative excursion of said alternating current source voltage.

48. The deactivator of claim 29, wherein said resonant recharge circuit provides a partial charge for said deactivation capacitor during each of two or more successive negative excursions of said alternating current source voltage.

49. The deactivator of claim 29, wherein said resonant recharge circuit charges said deactivation capacitor during bath positive and negative excursions of said alternating current source voltage.

50. The deactivator of claim 29, wherein said resonant recharge circuit provides a partial charge for said deactivation capacitor during each of a series of successive positive and negative excursions of said alternating current source voltage.

51. A method, comprising:

receiving a signal to deactivate a marker at a deactivator;

creating a deactivation field to deactivate said marker during a deactivation cycle for said deactivator, said deactivation field to generate a resonant charge pulse; and charging said deactivator using said resonant charge pulse during a recharge cycle for said deactivator.

52. The method of claim 51, wherein said creating comprises:

turning off a recharge switch to disconnect a power source from a deactivation capacitor;

turning on a deactivation switch to send current from said deactivation capacitor to a deactivation coil; and generating an alternating current magnetic field by said deactivation coil in accordance with a current waveform, with said current waveform having an initial negative current pulse to form said resonant charge pulse.

53. The method of claim 52, wherein said charging comprises:

turning on said recharge switch to connect said deactivation capacitor to said power source; and turning off said deactivation switch to send said resonant charge pulse to said deactivation capacitor.

54. The method of claim 53, further comprising generating control signals by a deactivation control to control said recharge switch and said deactivation switch.

* * * * *